US008367581B2

(12) United States Patent
Kitano

(10) Patent No.: US 8,367,581 B2
(45) Date of Patent: Feb. 5, 2013

(54) THERMOSENSITIVE RECORDING MEDIUM WITH ANTIBACTERIAL PROPERTY

(75) Inventor: Tohru Kitano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 430 days.

(21) Appl. No.: 12/558,932

(22) Filed: Sep. 14, 2009

(65) Prior Publication Data

US 2010/0069241 A1 Mar. 18, 2010

(30) Foreign Application Priority Data

Sep. 16, 2008 (JP) ..... 2008-236661
Jul. 2, 2009 (JP) ..... 2009-157547

(51) Int. Cl.
*B41M 5/333* (2006.01)
*B41M 5/337* (2006.01)

(52) U.S. Cl. ..... 503/209; 503/207; 503/216; 503/226

(58) Field of Classification Search ..... None
See application file for complete search history.

(56) References Cited

U.S. PATENT DOCUMENTS 5,071,822 A 12/1991 Nakamura et al.
6,723,444 B2 * 4/2004 Kobayashi et al. ..... 428/480
2006/0068191 A1 3/2006 Goto et al.
2006/0159913 A1 7/2006 Kugo et al.
2008/0070035 A1 3/2008 Kitano et al.

FOREIGN PATENT DOCUMENTS

| | | | |
|---|---|---|---|
| EP | 0338587 A2 | | 10/1989 |
| JP | 04-239690 | * | 8/1992 |
| JP | 6-158002 | | 6/1994 |
| JP | 9-95051 | | 4/1997 |
| JP | 9-123602 | | 5/1997 |
| JP | 11-58964 | | 3/1999 |
| JP | 2001-48710 | | 2/2001 |
| JP | 2001-137279 | | 5/2001 |
| JP | 2002-188067 | | 7/2002 |
| JP | 2005-120008 | | 5/2005 |
| JP | 2006-256203 | | 9/2006 |
| JP | 2007-68723 | | 3/2007 |
| JP | 2007-211004 | | 8/2007 |

OTHER PUBLICATIONS

Dec. 23, 2009 European search report in connection with counterpart European application No. 09 17 0280.

* cited by examiner

*Primary Examiner* — Bruce H Hess
(74) *Attorney, Agent, or Firm* — Cooper & Dunham LLP

(57) ABSTRACT

To provide a thermosensitive recording medium including: a support; a thermosensitive recording layer composed mainly of a leuco dye and a developer, formed on a surface of the support; and at least two antibacterial agents which include a zirconium phosphate antibacterial agent and an imidazole antibacterial agent and which are internally contained in the thermosensitive recording medium.

18 Claims, No Drawings

THERMOSENSITIVE RECORDING MEDIUM WITH ANTIBACTERIAL PROPERTY

BACKGROUND OF THE INVENTION

1. Field of the Invention

The present invention relates to a thermosensitive recording medium which has sufficient antibacterial efficacy and is chemical-resistant, notably plasticizer-resistant, and superior in image residual rate. The present invention relates particularly to a thermosensitive recording medium suitable for use in the fields of medicine and food.

2. Description of the Related Art

In recent years, along with the diversification of information and the expansion of needs, a variety of types of recording materials have been studied, developed and put to practical use in the field of information recording. Among the recording materials, thermosensitive recording materials are advantageous, for example in that (1) simplified recording of images is enabled by a heating process alone, and (2) required apparatuses have simple mechanisms and can therefore be easily made compact and the recording materials are easy to handle and inexpensive. Accordingly, techniques for such recording materials are widely utilized, for example, in the fields of information processing (for output of desk calculators, computers, etc.), recorders for medical measurement, low-speed to high-speed facsimiles, automated ticket machines (for passenger tickets, admission tickets, etc.), thermosensitive copying, labels in the POS system, and tags.

A thermosensitive recording medium generally includes at least a support and a thermosensitive recording layer, and a thermosensitive recording adhesive label includes an adhesive layer and release paper in addition to a support and a thermosensitive recording layer. The release paper is obtained by coating polyethylene-laminated paper, clay-coated paper, high-density base paper such as glassine paper, etc. with a release agent such as a silicone compound or fluorine compound. Examples of an adhesive constituting the adhesive layer include hot-melt adhesives, solvent adhesives and emulsion adhesives such as rubber adhesives, acrylic adhesives and vinyl ether adhesives. Among these, acrylic emulsion adhesives, in particular, are widely used for their safety, quality and inexpensiveness.

Also, the thermosensitive recording medium is generally required to store a recorded image stably; accordingly, there have been proposed a method of coating the thermosensitive recording layer with an aqueous emulsion of a resin which is capable of forming a film and is chemical-resistant, and a method of coating the thermosensitive recording layer with a water-soluble polymer compound such as polyvinyl alcohol. As for the thermosensitive recording adhesive label, the adhesive layer and the release paper are provided on the back surface of the support; as described above, the adhesive constituting the adhesive layer is generally selected from rubber adhesives, acrylic adhesives and the like, particularly acrylic emulsion adhesives. Thus, a low-molecular-weight oligomer, a surfactant and the like contained in the adhesive layer may migrate to the thermosensitive recording layer while the thermosensitive recording adhesive label is stored for a long period of time, even before it starts being used as a label, thereby possibly causing such known problems that the recording sensitivity decreases, and the image density decreases when the label is chemical-resistant, particularly plasticizer-resistant.

Further, more and more antibacterial products, notably fiber and plastic antibacterial products, are becoming widely available, and they are widely utilized in a variety of fields, e.g. for bath-related uses, kitchen equipment, food-related uses, electric appliances, office machines, office equipment and medical uses. In food-related uses, in particular, the antibacterial products are expected to be used as discount-showing labels attached onto wrappings covering foamed trays for foods. In medical uses, the antibacterial products are expected to be used as labels attached onto blood collection tubes, infusion bottles and the like in an attempt to solve the serious problem of in-hospital infection. Also, there is a great problem with the disposal of materials which can be noxious sources of secondary infection, contained in medical waste discharged from medical institutions and the like.

Regarding labels with antibacterial agents, tapes for medical uses in which adhesive layers contain silver-based antibacterial agents have been proposed, (refer to Japanese Patent Application Laid-Open (JP-A) No. 2001-137279, for example). However, the silver-based antibacterial agents are not effective unless in contact with microorganisms such as bacteria, so that effects cannot be expected from the silver-based antibacterial agents without them being used near water.

Meanwhile, sheets which contain volatile antibacterial agents have been proposed (refer to JP-A Nos. 2005-120008 and 2007-68723, for example). However, when used as thermosensitive recording materials, they cannot be satisfactorily used because images recorded thereon by thermosensitive recording degrade with time.

Also, tapes and tack seals, in which organic antibacterial insecticides and/or inorganic antibacterial fungicides are mixed with adhesives have been proposed (refer to JP-A No. 2001-48710, for example). However, natural antibacterial agents are used therein, so that when they are used as thermosensitive recording materials, they cannot be satisfactorily used because images recorded thereon by thermosensitive recording degrade with time.

Meanwhile, inclusion of antibacterial agents based upon haloalkylthiophthalimide and/or chlorhexidine gluconate in thermosensitive recording media has been proposed (refer to JP-A Nos. 09-123602 and 11-58964, for example). However, thermosensitive recording layers decrease in sensitivity at high temperatures and high humidity.

Further, thermosensitive recording media which contain inorganic ion antibacterial agents have been proposed (refer to JP-A No. 09-95051, for example). However, effects cannot be expected from the thermosensitive recording media unless the antibacterial agents are in direct contact with microorganisms such as bacteria.

Also, dispersions or surface coating treatment agents, which contain inorganic antibacterial agents and imidazole antibacterial agents have been proposed (refer to JP-A No. 2007-211004, for example). However, the dispersions or the surface coating treatment agents contain organic solvents as their essential components, so that when used for thermosensitive recording materials, there is such a problem that fogging of background portions of images recorded by thermosensitive recording arises.

BRIEF SUMMARY OF THE INVENTION

The present invention is aimed at solving the above-mentioned problems in related art and achieving the following object. An object of the present invention is to provide a highly practical thermosensitive recording medium which is chemical-resistant, notably plasticizer-resistant, and superior in image residual rate, has antibacterial properties and is suitable as a label used with food in the POS system, a label attached onto a blood collection tube, an infusion bottle, etc. in the medical field, or the like.

The present invention is designed based upon the knowledge of the present inventors, and means for solving the above-mentioned problems are as follows.

<1> A thermosensitive recording medium including: a support; a thermosensitive recording layer composed mainly of a leuco dye and a developer, formed on a surface of the support; and at least two antibacterial agents which include a zirconium phosphate antibacterial agent and an imidazole antibacterial agent and which are internally contained in the thermosensitive recording medium.

<2> The thermosensitive recording medium according to <1>, wherein the developer is a compound represented by General Formula (I) below:

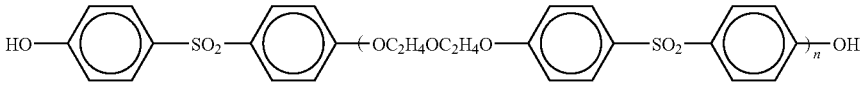

(I)

where n denotes a natural number of 1 to 7.

<3> The thermosensitive recording medium according to one of <1> and <2>, further including an overcoat layer on the thermosensitive recording layer.

<4> The thermosensitive recording medium according to <3>, wherein the overcoat layer includes the at least two antibacterial agents which include the zirconium phosphate antibacterial agent and the imidazole antibacterial agent.

<5> The thermosensitive recording medium according to any one of <1> to <4>, further including an undercoat layer between the support and the thermosensitive recording layer.

<6> The thermosensitive recording medium according to <5>, wherein the undercoat layer contains hollow particles having a hollowness of 80% or more.

<7> The thermosensitive recording medium according to one of <5> and <6>, wherein the undercoat layer includes the at least two antibacterial agents which include the zirconium phosphate antibacterial agent and the imidazole antibacterial agent.

<8> The thermosensitive recording medium according to any one of <1> to <7>, further including a back coat layer on a side of the support opposite to the thermosensitive recording layer.

<9> The thermosensitive recording medium according to <8>, wherein the back coat layer includes the at least two antibacterial agents which include the zirconium phosphate antibacterial agent and the imidazole antibacterial agent.

<10> The thermosensitive recording medium according to any one of <1> to <9>, further including a pyridine antibacterial agent internally contained therein.

<11> The thermosensitive recording medium according to <10>, wherein the pyridine antibacterial agent is a pyridinethiol compound.

<12> The thermosensitive recording medium according to one of <10> and <11>, wherein the overcoat layer includes the pyridine antibacterial agent.

<13> The thermosensitive recording medium according to any one of <1> to <12>, being used as thermosensitive recording paper.

<14> The thermosensitive recording medium according to any one of <1> to <13>, further including an acrylic adhesive layer and release paper sequentially formed on the side of the support opposite to the thermosensitive recording layer.

<15> The thermosensitive recording medium according to <14>, wherein the acrylic adhesive layer includes the at least two antibacterial agents which include the zirconium phosphate antibacterial agent and the imidazole antibacterial agent.

<16> The thermosensitive recording medium according to one of <14> and <15>, wherein the acrylic adhesive layer includes the pyridine antibacterial agent.

<17> The thermosensitive recording medium according to any one of <14> to <16>, being used as a thermosensitive recording adhesive label.

According to the present invention, it is possible to solve the above-mentioned problems and provide a highly practical thermosensitive recording medium which is chemical-resistant, notably plasticizer-resistant, and superior in image residual rate and has antibacterial properties even when stored for a long period of time, and which is suitable as a label used with food in the POS system, a label attached onto a blood collection tube, an infusion bottle, etc. in the medical field, or the like.

DETAILED DESCRIPTION OF THE INVENTION

Thermosensitive Recording Medium

A thermosensitive recording medium of the present invention includes a support; a thermosensitive recording layer composed mainly of a leuco dye and a developer, formed on a surface of the support; and at least two antibacterial agents which include a zirconium phosphate antibacterial agent and an imidazole antibacterial agent and which are internally contained in the thermosensitive recording medium. Further, the thermosensitive recording medium includes other components if necessary.

<Thermosensitive Recording Layer>

The thermosensitive recording layer includes the leuco dye and the developer and, if necessary, includes other components.

—Leuco Dye—

The leuco dye is a compound which exhibits electron-donating properties. As the leuco dye, a single such compound may be used, or two or more such compounds may be used in a mixed manner. The leuco dye itself is a colorless or pale dye precursor and can be selected from conventionally known leuco dyes without any limitation in particular. Preferred examples thereof include leuco compounds such as triphenylmethane phthalide compounds, triallylmethane compounds, fluoran compounds, phenothiazine compounds, thiofluoran compounds, xanthene compounds, indophthalyl compounds, spiropyran compounds, azaphthalide compounds, chromenopyrazole compounds, methine compounds, rhodamineanilinolactam compounds, rhodaminelactam compounds, quinazoline compounds, diazaxanthene compounds and bislactone compounds.

Specific examples of the leuco compounds include 3-dibutylamino-6-methyl-7-anilinofluoran, 6-[ethyl(4-methylphenyl)amino]-3-methyl-2-anilinofluoran, 2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-s-butyl-N-ethylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trifluoromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino)fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino)fluoran, 2-benzylamino-6-(N-ethyl-p-toluidino) fluoran, 2-benzylamino-6-(N-methyl-2,4-dimethylanilino) fluoran, 2-benzylamino-6-(N-ethyl-2,4-dimethylanilino) fluoran, 2-dibenzylamino-6-(N-methyl-p-toluidino)fluoran, 2-dibenzylamino-6-(N-ethyl-p-toluidino)fluoran, 2-(di-p-methylbenzylamino)-6-(N-ethyl-p-toluidino)fluoran, 2-α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-methyl-2,4-dimethylanilino)fluoran, 2-dimethylamino-6-(N-methylanilino)fluoran, 2-dimethylamino-6-(N-ethylanilino) fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino) fluoran, 2-amino-6-(N-ethyl-p-chloroanilino)fluoran, 2-amino-6-(N-propyl-p-chloroanilino)fluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 1,2-benzo-6-(N-ethyl-N-isoamylamino)fluoran, 1,2-benzo-6-dibutylaminofluoran, 1,2-benzo-6-(N-ethyl-N-cyclohexylamino)fluoran, 1,2-benzo-6-(N-ethyl-toluidino)fluoran, 2-anilino-3-methyl-6-(N-2-ethoxypropyl-N-ethylamino)fluoran, 2-(p-chloroanilino)-6-(N-n-octylamino)fluoran, 2-(p-chloroanilino)-6-(N-n-palmitylamino)fluoran, 2-(p-chloroanilino)-6-(di-n-octylamino)fluoran, 2-benzoylamino-6-(N-ethyl-p-toluidino)fluoran, 2-(o-methoxybenzoylamino)-6-(N-ethyl-p-toluidino)fluoran, 2-dibenzylamino-4-methyl-6-diethylaminofluoran, 2-dibenzylamino-4-methoxy-6-(N-methyl-p-toluidino)fluoran, 2-dibenzylamino-4-methyl-6-(N-ethyl-p-toluidino)fluoran, 2-(α-phenylethylamino)-4-methyl-6-diethylaminofluoran, 2-(p-toluidino)-3-(t-butyl)-6-(N-methyl-p-toluidino)fluoran, 2-(o-methoxycarbonylanilino)-6-diethylaminofluoran, 2-acetylamino-6-(N-methyl-p-toluidino)fluoran, 3-diethylamino-6-(m-trifluoromethylanilino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino)fluoran, 2-(α-phenylethylamino)-4-chloro-6-diethylaminofluoran, 2-(N-benzyl-p-trifluoromethylanilino)-4-chloro-6-diethylaminofluoran, 2-aniline-3-methyl-6-pyrrolidinofluoran, 2-anilino-3-chloro-6-pyrrolidinofluoran, 2-anilino-3-methyl-6-(N-ethyl-N-tetrahydrofurfurylamino)fluoran, 2-mesidino-4',5'-benzo-6-diethylaminofluoran, 2-(m-trifluoromethylanilino)-3-methyl-6-pyrrolidinofluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholinofluoran, 2-(di-N-p-chlorophenyl-methylamino)-6-pyrrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleuco methylene blue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl) phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl) phthalide, 3-(2-hydroxy-4-diethylaminophenyl)-3-(2-methoxy-5-methylphenyl)phthalide, 3,6-bis(dimethylamino)fluorenespiro(9,3'-6'-dimethylaminophthalide, 6'-chloro-8'-methoxy-benzoindolino-spiropyran and 6'-bromo-2'-methoxy-benzoindolino-spiropyran.

—Developer—

The developer can be selected from a variety of electron-accepting substances capable of reacting with the leuco dye when heated and making the leuco dye form color. Specific examples of the developer include the following phenolic compounds, organic acid compounds, inorganic acid compounds, and esters and salts of these compounds.

Gallic acid, salicylic acid, 3-isopropyl salicylic acid, 3-cyclohexyl salicylic acid, 3,5-di-t-butyl salicylic acid, 3,5-di-α-methylbenzyl salicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-t-butylphenol), 4,4'-s-butylidenediphenol, 4,4'-cyclohexylidenebisphenol, 4,4'-cyclohexylidenebis(2-methylphenol), 4-t-butylphenol, 4-phenylphenol, 4-hydroxydiphenoxide, α-naphthol, β-naphthol, 3,5-xylenol, thymol, methyl-4-hydroxybenzoate, 4-hydroxyacetoacetophenone, novolac-type phenolic resins, 2,2'-thiobis(4,6-dichlorophenol), catechol, resorcin, hydroquinone, pyrogallol, fluoroglycine, fluoroglycine carboxylic acid, 4-t-octylcatechol, 2,2'-methylenebis(4-chlorophenol), 2,2'-methylenebis(4-methyl-6-t-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, 2-hydroxy-6-zinc naphthoate, 4-hydroxydiphenylsulfone, 4-hydroxy-4'-chlorodiphenylsulfone, bis(4-hydroxyphenyl)sulfide, 2-hydroxy-p-toluic acid, 3,5-di-t-zinc butyl salicylate, 3,5-di-t-tin butyl salicylate, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, bis(4-hydroxyphenyl)ethyl acetate, bis(4-hydroxyphenyl)n-propyl acetate, bis(4-hydroxyphenyl)n-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetate, bis(3-methyl-4-hydroxyphenyl)methyl acetate, bis(3-methyl-4-hydroxyphenyl)n-propyl acetate, 1,7-bis(4-hydroxyphenylthio)-3,5-dioxaheptane, 1,5-bis(4-hydroxyphenylthio)-3-oxapentane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4'-s-butoxydiphenylsulfone, 4-hydroxy-4'-t-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone.

Compounds represented by General Formula (I) below can be developers superior in oil resistance and plasticizer resistance and can further reduce the decrease in color formation density even when an antibacterial agent is added to the thermosensitive recording medium.

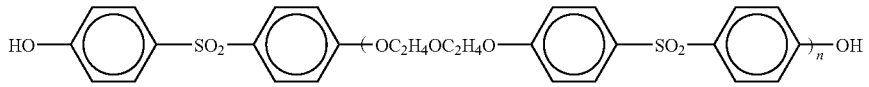

(I)

(In General Formula (I), n denotes a natural number of 1 to 7.)

—Other Components—

The above-mentioned other components are not particularly limited and may be suitably selected according to the purpose. Examples thereof include auxiliary additives commonly used for this sort of thermosensitive recording material, such as a water-soluble polymer, an aqueous resin emulsion, a filler, a thermofusible substance and a surfactant. The above-mentioned other components may be used individually or in combination.

The water-soluble polymer and the aqueous resin emulsion are not particularly limited and may be selected from known compounds generally used for thermosensitive recording layers.

The filler is not particularly limited and may be suitably selected according to the purpose. Examples thereof include inorganic fine powders such as powders of calcium carbonate, silica, zinc oxide, titanium oxide, aluminum hydroxide, zinc hydroxide, barium sulfate, clay, talc, and surface-treated calcium carbonate and silica; and organic fine powders such as powders of urea-formalin resins, styrene-methacrylic acid copolymers and polystyrene resins.

The thermofusible substance is not particularly limited and may be suitably selected according to the purpose. Examples thereof include fatty acids such as stearic acid and behenic acid; fatty acid amides such as stearic acid amide and palmitic acid amide; fatty acid metal salts such as zinc stearate, aluminum stearate, calcium stearate, zinc palmitate and zinc behenate; p-benzylbiphenyl, m-terphenyl, triphenylmethane, benzyl p-benzyloxybenzoate, β-benzyloxy naphthalene, phenyl β-naphthoate, 1-hydroxy-2-phenyl naphthoate, 1-hydroxy-2-methyl naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzyl disulfide, 1,1-diphenylethanol, 1,1-diphenylpropanol, p-benzyloxybenzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, 1,2-bis(3,4-dimethylphenyl)ethane, dibenzyl oxalate, bis(4-methylbenzyl) oxalate, bis(4-chlorobenzyl) oxalate and 4-acetotoluidide; and other thermofusible organic compounds having melting points of approximately 50° C. to 200° C.

<Support>

Base paper favorably used as the support is composed mainly of wood pulp and a loading filler. The wood pulp is not particularly limited and may be suitably selected according to the purpose. Examples of the wood pulp include chemical pulps such as LBKP and NBKP, mechanical pulps such as GP, PGW, RMP, TMP, CTMP, CMP and CGP, and recycled pulps such as DIP. Also, one or more conventionally known additives such as a pigment, a binder, a sizing agent, a fixing agent, a yield enhancer, a cationizing agent and a paper strength agent may be added to the support, if necessary.

The support can be produced using an apparatus such as a Fourdrinier paper machine, a cylinder paper machine or a twin-wire paper machine and made acidic, neutral or alkaline.

The base paper may be subjected to on-machine calendering using a calendering apparatus including a metal roll and a synthetic resin roll. Alternatively, the base paper may be subjected to off-machine calendering and then subjected to machine calendering, super calendering, etc. so as to control its flatness.

The loading filler contained in the base paper is not particularly limited and may be suitably selected according to the purpose. Examples thereof include white inorganic pigments such as light calcium carbonate, heavy calcium carbonate, kaolin, talc, calcium sulfate, barium sulfate, titanium dioxide, zinc oxide, zinc sulfide, satin white, aluminum silicate, diatomaceous earth, calcium silicate, magnesium silicate, synthetic silica, aluminum hydroxide, alumina, lithopone, zeolite, magnesium carbonate and magnesium hydroxide; and organic pigments such as styrene plastic pigments, acrylic plastic pigments, polyethylene, microcapsules, urea resins and melamine resins.

The sizing agent for use in the base paper is not particularly limited and may be suitably selected according to the purpose. Examples thereof include rosin sizing agents for acidic papermaking, modified rosin sizing agents for neutral papermaking, AKD, ASA and cationic polymer sizing agents.

Commonly used paper such as commercially available high-quality paper, glassine paper, art paper, coated paper or cast paper may also be used as the support, and raw materials generally used in papermaking, such as a loading filler, a sizing agent, a paper strength agent and a dye, may be additionally used if necessary. Other examples of the support include plastic sheets made of polyethylene, polypropylene, polyethylene terephthalate or polyamides; unwoven fabrics and synthetic paper made of synthetic fibers of these substances; laminated paper with its one or both surfaces coated with a synthetic resin; metal foil; metal foil with paper; vapor-deposited paper; holographic opaque sheets; products with synthetic resin films; mica paper; and glass paper.

<Other Components>

The above-mentioned other components included, if necessary, in the thermosensitive recording medium are not particularly limited and may be suitably selected according to the purpose. Examples thereof include an overcoat layer, an undercoat layer, a back coat layer, an adhesive layer and release paper.

—Overcoat Layer—

Regarding the thermosensitive recording medium, provision of an overcoat layer on the thermosensitive recording layer is preferable. The provision of the overcoat layer makes it possible to prevent a color formation hindering factor, contained in the thermosensitive recording medium that is stored or used generally in the form of a roll, from penetrating through release paper and having an adverse effect on the thermosensitive recording layer. Without an overcoat layer being provided on the thermosensitive recording layer, sufficient barrier properties cannot be obtained, which may cause a reduction in color forming capability depending upon the use environment.

The overcoat layer is composed mainly of a polyvinyl alcohol resin and a filler.

The resin is produced, for example, by a known method and may contain a monomer capable of copolymerizing with a vinyl ester, besides a saponified material of polyvinyl acetate. Examples of the monomer include olefins such as ethylene, propylene and isobutylene; unsaturated acids such as acrylic acid, methacrylic acid, crotonic acid, maleic acid, maleic anhydride and itaconic acid, and salts thereof; nitriles such as acrylonitrile and methacrylonitrile; amides such as acrylamide and methacrylamide; and olefin sulfonic acids such as ethylene sulfonic acid, allyl sulfonic acid and methallyl sulfonic acid, and salts thereof.

Examples of the filler include inorganic fillers such as phosphate fiber, potassium titanate, needle-like magnesium hydroxide, whiskers, talc, mica, glass flakes, calcium carbonate, plate-like calcium carbonate, aluminum hydroxide, plate-like aluminum hydroxide, silica, clay, kaolin, talc, baked clay and hydrotalcites; and organic fillers such as cross-linked polystyrene resins, urea resins, silicone resins, cross-linked polymethyl methacrylate resins and melamine-formaldehyde resins.

Additionally, it is particularly preferable to add a water resistant agent in order to improve the water resistance of the overcoat layer. Specific examples of the water resistant agent include glyoxal, melamine-formaldehyde resins, polyamide resins and polyamide-epichlorohydrin resins.

Further, besides the resin and the filler, conventionally used auxiliary additives such as a surfactant, a thermofusible substance, a lubricant and a pressure-related color formation preventing agent may be used for the overcoat layer. Specific examples of the thermofusible substance are similar to those already mentioned in relation to the thermosensitive recording layer.

The amount of the overcoat layer attached is preferably in the range of 1.0 g/m$^2$ to 5.0 g/m$^2$ after dried. When the amount is smaller than 1.0 g/m$^2$, there is degradation of the storage stability of a recorded image against water and acidic substances contained in foods, and plasticizers, oils and fats, etc. contained in organic polymer materials used for wrapping. When the amount is larger than 5.0 g/m$^2$, there is degradation of color formation sensitivity.

—Undercoat Layer—

Additionally, regarding the thermosensitive recording medium, an undercoat layer which contains a binder, a filler, a thermofusible substance, etc. is preferably provided between the support and the thermosensitive recording layer according to necessity, for the purpose of preventing an adhesive from migrating to the thermosensitive recording layer, improving color formation sensitivity, flatness and adhesion, and so forth.

It is desirable to use hollow particles as the filler of the undercoat layer. For instance, hollow particles including shells made of a thermoplastic resin and having a hollowness of 30% or greater (generally in the range of 33% to 99%) and a mass average particle diameter of 0.4 μm to 10 μm may be used. The hollowness (%) herein mentioned is the ratio of the diameter of the hollow portion of each hollow particle to the outer diameter of each hollow particle, which is represented by (Diameter of hollow portion of hollow particle/Outer diameter of hollow particle)×100.

As the binder and the thermofusible substance, ones similar to those mentioned in relation to the overcoat layer may be used.

The undercoat layer is desirably provided such that the amount thereof attached is in the range of 2 g/m$^2$ to 10 g/m$^2$ after dried. It is more desirable that the undercoat layer contain hollow particles having a hollowness of 80% or greater and a mass average particle diameter of 0.8 μm to 5 μm and that the amount of the undercoat layer attached be in the range of 2.5 g/m$^2$ to 7 g/m$^2$ after dried. This makes it possible to provide a thermosensitive recording medium having high color formation sensitivity when printed with an image.

The hollow particles preferably occupy 35% by mass to 80% by mass of the overall composition of the undercoat layer. The specific gravity of the hollow particles changes depending upon their hollowness, and the mass ratio of the hollow particles decreases as their hollowness increases. When the hollow particles occupy less than 35% by mass, sensitivity-related effects are hard to obtain. When the hollow particles occupy more than 80% by mass, layer adhesion is impaired.

—Back Coat Layer—

The thermosensitive recording medium is preferably provided with a back coat layer on a side of the support opposite to the thermosensitive recording layer. In the case where the thermosensitive recording medium is not provided with a back coat layer, a color formation hindering factor contained in an adhesive layer may infiltrate into the thermosensitive recording layer and hinder color formation when the medium is used after stored for a long period of time which follows a process of providing the medium with adhesiveness.

The amount of the back coat layer attached is preferably in the range of 0.5 g/m$^2$ to 3.5 g/m$^2$, more preferably in the range of 1.0 g/m$^2$ to 3.4 g/m$^2$, after dried. When the amount is smaller than 0.5 g/m$^2$, curling cannot be reduced in a low-humidity environment. When the amount is larger than 3.5 g/m$^2$, blocking is easily caused when the medium is stored in the form of a roll.

The back coat layer is composed mainly of a polyvinyl alcohol resin and a curing agent for the polyvinyl alcohol resin.

The polyvinyl alcohol resin used for the back coat layer is produced by a known method and may contain a monomer capable of copolymerizing with a vinyl ester, besides a saponified material of polyvinyl acetate. Examples of the monomer include olefins such as ethylene, propylene and isobutylene; unsaturated acids such as acrylic acid, methacrylic acid, crotonic acid, maleic acid, maleic anhydride and itaconic acid, and salts thereof; nitriles such as acrylonitrile and methacrylonitrile; amides such as acrylamide and methacrylamide; and olefin sulfonic acids such as ethylene sulfonic acid, allyl sulfonic acid and methallyl sulfonic acid, and salts thereof.

Additionally, a curing agent such as glyoxal, boric acid, alum, polyamide resin, epoxy resin or dialdehyde starch may be added to the back coat layer to enhance its barrier properties.

Auxiliary agents may if necessary be added into a back coat layer coating solution composed mainly of the above-mentioned materials as long as the effects of the present invention are not hindered.

The auxiliary agents are not particularly limited and may be suitably selected according to the purpose. Examples thereof include zinc stearate and calcium stearate; waxes such as polyethylene wax, carnauba wax, paraffin wax and ester wax; dispersants such as sodium dioctyl sulfosuccinate, dodecylbenzenesulfonic acid sodium salt, lauryl alcohol sulfuric acid ester sodium salt, alginic acid salt and fatty acid metal salts; ultraviolet absorbers such as benzophenone-based compounds and benzotriazole-based compounds; inorganic pigments such as magnesium carbonate, calcite light calcium carbonate, aragonite light calcium carbonate, heavy calcium carbonate, aluminum hydroxide, titanium dioxide, silicon dioxide, barium sulfate, zinc sulfate, talc, kaolin, clay, baked kaolin, alkali modified silica, anhydrous silica fine particles and colloidal silica; and organic pigments such as styrene microballs, nylon powder, polyethylene powder and urea-formalin resin fillers.

—Adhesive Layer—

The thermosensitive recording medium may be further provided with an acrylic adhesive layer on the side of the support opposite to the thermosensitive recording layer. The provision of the adhesive layer makes it possible for the thermosensitive recording medium to be suitably used as a thermosensitive recording adhesive label.

The adhesive layer is not particularly limited as long as it is provided on the side of the support opposite to the thermosensitive recording layer, and the adhesive layer may be suitably selected according to the purpose. The adhesive layer may be formed under the back coat layer provided on the side of the support opposite to the thermosensitive recording layer.

The adhesive used for the adhesive layer preferably contains as its main component(s) at least one selected from the group consisting of acrylic acid ester-methacrylic acid ester-styrene copolymers, acrylic acid ester-styrene copolymers, and acrylic resins obtained by emulsifying and polymerizing monomers each composed mainly of at least one kind of alkyl group-containing (meth)acrylic acid alkyl ester. Here, the term "main component(s)" means that the adhesive layer only contains the resin(s) except for additives such as a penetrant, a film formation auxiliary agent, an antifoaming agent, an antirust agent, a thickening agent, a wetting agent, a preservative, an ultraviolet absorber, a light stabilizer, a pigment and an inorganic filler which are added if necessary. The term "(meth)acrylic" in the present specification means either acrylic or methacrylic.

Specific examples of the (meth)acrylic acid alkyl ester include n-pentyl (meth)acrylate, n-hexyl (meth)acrylate, 2-ethylhexyl (meth)acrylate, n-octyl (meth)acrylate, isooctyl (meth)acrylate, n-decyl (meth)acrylate and n-dodecyl (meth) acrylate. These may be used in combination.

Also, besides any of these components, a carboxyl group-containing radically polymerizable unsaturated monomer, and/or a radically polymerizable unsaturated monomer capable of copolymerizing with a meth(acrylic) acid alkyl ester and/or with a carboxyl group-containing radically polymerizable unsaturated monomer may if necessary be added.

Specific examples of the carboxyl group-containing radically polymerizable unsaturated monomer include α,β-unsaturated carboxylic acids such as (meth)acrylic acid; and α,β-unsaturated dicarboxylic acids such as itaconic acid, maleic acid and 2-methyleneglutaric acid. These may be used in combination.

Here, the amount of the adhesive attached is preferably in the range of 8 g/m$^2$ to 20 g/m$^2$ after dried. When the amount is smaller than 8 g/m$^2$, sufficient adhesion cannot be obtained, and so the thermosensitive recording medium may not be able to be affixed to an object with a rough surface such as corrugated paper. When the amount is larger than 20 g/m$^2$, the thermosensitive recording medium has greater adhesion than necessary, which is unfavorable from an economical viewpoint.

The method of applying the adhesive is not particularly limited and may be suitably selected according to the purpose. For instance, the adhesive is applied using a roll coater, knife coater, bar coater, slot dye coater, curtain coater or the like and may be applied onto the release agent surface of the after-mentioned release paper or onto the back surface of the support (the surface on the side opposite to the thermosensitive recording layer).

—Release Paper—

In the case where the thermosensitive recording medium includes the adhesive layer, it is desirable that release paper be laid on the adhesive layer provided on the side of the support opposite to the thermosensitive recording layer.

As for production of the release paper, first of all, what is prepared is a base material which includes high-grade base paper such as glassine paper or base paper such as clay-coated paper, kraft paper or high-quality paper, and a filler layer formed of a natural or synthetic resin, e.g. casein, dextrin, starch, carboxymethyl cellulose, methyl cellulose, ethyl cellulose, hydroxyethyl cellulose, polyvinyl alcohol, styrene-butadiene copolymer, ethylene-vinyl chloride copolymer, methylmethacrylate-butadiene copolymer, ethylene-vinyl acetate copolymer or (meth)acrylic acid ester copolymer, or formed of such a resin and an inorganic pigment, e.g. kaolin, clay, calcium carbonate, baked clay (baked kaolin), titanium oxide or silica, or an organic pigment, e.g. plastic pigment; alternatively, what is prepared is polymer laminated paper obtained by coating kraft paper or high-quality paper with a synthetic resin such as polyethylene. Subsequently, a solvent or solventless silicone resin, fluorine resin or the like is applied onto the acrylic adhesive layer such that the amount of the resin attached is in the range of approximately 0.05 $g/m^2$ to 3 $g/m^2$ after dried, and then the resin is subjected to thermal curing, electron beam curing, ultraviolet curing, etc. so as to form a release agent layer on the base material or the polymer laminated paper. Although a device to apply the release agent is not particularly limited, a bar coater, direct gravure coater, offset gravure coater, air knife coater, multiple roll coater or the like is used, for example.

<Antibacterial Agent>

Inclusion of an antibacterial agent in the thermosensitive recording medium makes it possible to exhibit antibacterial efficacy. In order to strike a balance between antibacterial efficacy and prevention of any hindrance to the color forming properties of the thermosensitive recording layer, a zirconium phosphate antibacterial agent and an imidazole antibacterial agent need to be included as essential components. Especially when a naturally derived antibacterial agent is added to the thermosensitive recording medium, the high volatility of the antibacterial agent easily hinders the color forming properties of the thermosensitive recording layer.

—Zirconium Phosphate Antibacterial Agent—

The zirconium phosphate antibacterial agent is zirconium phosphate on which an antibacterial metal ion is supported. Examples thereof include silver ion-supported zirconium phosphate, copper ion-supported zirconium phosphate and zinc ion-supported zirconium phosphate, with preference being given to silver ion-supported zirconium phosphate, in other words zirconium phosphate-silver.

—Imidazole Antibacterial Agent—

Meanwhile, examples of the imidazole antibacterial agent include methyl 2-benzimidazolecarbamate, methyl 1-butylcarbamoyl-2-benzimidazolecarbamate, methyl 6-benzoyl-2-benzimidazolecarbamate, methyl 6-(2-thiophenecarbonyl)-2-benzimidazolecarbamate, 2-(4-thiazolyl)-benzimidazole, 2-(2-chlorophenyl)-benzimidazole, 2-(1-(3,5-dimethylpyrazol))benzimidazole, 2-(2-furyl)-benzimidazole, 2-thiocyanomethylthiobenzimidazole and 1-dimethylaminosulfonyl-2-cyano-4-bromo-6-trifluoromethylbenzimidazole, with preference being given to 2-(4-thiazolyl)-benzimidazole.

The zirconium phosphate antibacterial agent and the imidazole antibacterial agent are not particularly limited as long as they are contained in the thermosensitive recording medium, and may be suitably selected according to the purpose. It is desirable that they be contained in at least any one of the thermosensitive recording layer, the overcoat layer, the undercoat layer, the back coat layer and the adhesive layer which constitute the thermosensitive recording medium. It is more desirable that they be contained in the overcoat layer because they can easily come into direct contact with bacteria.

The zirconium phosphate antibacterial agent and the imidazole antibacterial agent may be separately contained in different layers; however, when they are contained in the same layer, synergetic antibacterial effects can be expected.

The amounts of the zirconium phosphate antibacterial agent and the imidazole antibacterial agent added are not particularly limited and may be suitably selected according to the purpose, but preferably each occupy 0.02% by mass to 3.5% by mass, more preferably 0.03% by mass to 2.0% by mass, of each layer of the thermosensitive recording medium. When the amounts each occupy less than 0.02% by mass, antibacterial efficacy may not be exhibited. When the amounts each occupy more than 3.5% by mass, the thermosensitive recording medium exhibits greater antibacterial efficacy than necessary, which is not economical, and a problem such as gelation arises depending upon the layer to which the antibacterial agents are added.

Other antibacterial agents may if necessary be added besides the zirconium phosphate antibacterial agent and the imidazole antibacterial agent, as long as the effects of the present invention are not hindered. Examples of the other antibacterial agents include inorganic antibacterial agents such as silver salt complexes, silver zeolite, antibacterial ceramic, thiabendazole, magnesium silicate pentahydrate and photocatalytically oxidized titanium; and organic antibacterial agents such as pyridine antibacterial agent, guanidine antibacterial agent, urea antibacterial agent, acridine antibacterial agent, quinoline antibacterial agent and haloalkylthio antibacterial agent. Also, the antibacterial agents mentioned in JP-A No. 10-109912, which are combinations of the above-mentioned antibacterial agents, may be used as well.

—Pyridine Antibacterial Agent—

Examples of the pyridine antibacterial agent include pyridinethiol compounds; specifically, sodium 2-pyridinethiol-1-oxide, zinc 2-pyridinethiol-1-oxide and the like. The above-mentioned other antibacterial agents such as the pyridine antibacterial agent may be contained in layers separately from the zirconium phosphate antibacterial agent and the imidazole antibacterial agent. However, when the other antibacterial agents are contained in a layer in which at least one of the zirconium phosphate antibacterial agent and the imidazole antibacterial agent is contained, synergetic antibacterial effects can be expected.

<Uses>

Uses of the thermosensitive recording medium of the present invention are not particularly limited and may be suitably selected according to the purpose. For instance, the thermosensitive recording medium can be favorably used as a highly practical thermosensitive recording adhesive label or thermosensitive recording paper which is chemical-resistant, notably plasticizer-resistant, and superior in image residual rate, has antibacterial properties and is suitable for use with food in the POS system or as a label attached onto a blood collection tube, an infusion bottle, etc. in the medical field, or the like.

EXAMPLES

The following explains the present invention in further detail, referring to Examples and Comparative Examples. It should, however, be noted that the present invention is not confined to these Examples. The term "part(s)" and the symbol "%" used below are both based upon mass.

[Thermosensitive Recording Paper]

Thermosensitive recording papers were produced in accordance with the formulations of Examples 1 to 12 and Comparative Examples 1 to 8 below.

Example 1

Preparation of Thermosensitive Recording Layer Solution

An A solution and a B solution having the following compositions were each dispersed using a sand mill so as to have an average particle diameter of 2 μm or less, and a dye dispersion solution [A solution] and a developer dispersion solution [B solution] were thus prepared.

| [A solution] | |
|---|---|
| 3-dibutylamino-6-methyl-7-anilinofluoran | 10 parts |
| 10% aqueous solution of itaconic acid-modified polyvinyl alcohol KL-318 (produced by KURARAY CO., LTD.) | 10 parts |
| water | 30 parts |

| [B solution] | |
|---|---|
| 4-hydroxy-4'-isopropoxydiphenylsulfone | 30 parts |
| di-(p-methylbenzyl) oxalate | 10 parts |
| 10% aqueous solution of itaconic acid-modified polyvinyl alcohol KL-318 (produced by KURARAY CO., LTD.) | 50 parts |
| silica | 15 parts |
| water | 197 parts |

Subsequently, the A solution and the B solution were agitated and mixed together with the following proportion so as to prepare a thermosensitive recording layer solution [C1 solution].

| [C1 solution] | |
|---|---|
| dye dispersion solution [A solution] | 50 parts |
| developer dispersion solution [B solution] | 302 parts |

<Preparation of Overcoat Layer Solution>

The following composition was dispersed for 24 hours using a sand mill so as to prepare a D solution.

| [D solution] | |
|---|---|
| aluminum hydroxide (having an average particle diameter of 0.6 μm, HIGILITE H-43M, produced by Showa Denko K.K.) | 20 parts |
| 10% aqueous solution of itaconic acid-modified polyvinyl alcohol | 20 parts |
| water | 60 parts |

Subsequently, the following composition was mixed and agitated so as to prepare an overcoat layer solution [E1 solution].

| [E1 solution] | |
|---|---|
| D solution | 75 parts |
| 10% aqueous solution of diacetone-modified polyvinyl alcohol | 100 parts |
| 10% aqueous solution of N-aminopolyacrylamide molecular weight: 10,000, hydrazide ratio: 50%) | 15 parts |
| zirconium phosphate-silver | 0.05 parts |
| 2-(4-thiazolyl)-benzimidazole | 0.05 parts |
| 1% aqueous solution of ammonia | 5 parts |
| water | 105 parts |

<Production of Thermosensitive Recording Paper>

The thermosensitive recording layer solution [C1 solution] and the overcoat layer solution [E1 solution] were applied onto the surface of commercially available high-quality paper (having a basis weight of 60 g/m$^2$) serving as a support and then dried so as to have masses of 2.85 g/m$^2$ and 3.0 g/m$^2$ respectively after dried. Then the paper with the dried solutions was calendered such that the surface had an Oken-type smoothness of approximately 2,000 seconds, and thermosensitive recording paper was thus produced.

Example 2

Thermosensitive recording paper was obtained in the same manner as in Example 1, except that an E2 solution having the following composition was used as an overcoat layer solution instead of the E1 solution.

| [E2 solution] | |
|---|---|
| D solution | 300 parts |
| 10% aqueous solution of diacetone-modified polyvinyl alcohol | 400 parts |
| 10% aqueous solution of N-aminopolyacrylamide (molecular weight: 10,000, hydrazide ratio: 50%) | 60 parts |
| zirconium phosphate-silver | 0.01 parts |
| 2-(4-thiazolyl)-benzimidazole | 0.01 parts |
| 1% aqueous solution of ammonia | 20 parts |
| water | 420 parts |

Example 3

Thermosensitive recording paper was obtained in the same manner as in Example 1, except that an E3 solution having the following composition was used as an overcoat layer solution instead of the E1 solution.

| [E3 solution] | |
|---|---|
| D solution | 75 parts |
| 10% aqueous solution of diacetone-modified polyvinyl alcohol | 100 parts |
| 10% aqueous solution of N-aminopolyacrylamide (molecular weight: 10,000, hydrazide ratio: 50%) | 15 parts |
| zirconium phosphate-silver | 0.5 parts |
| 2-(4-thiazolyl)-benzimidazole | 0.5 parts |
| 1% aqueous solution of ammonia | 5 parts |
| water | 105 parts |

Example 4

Thermosensitive recording paper was obtained in the same manner as in Example 1, except that an E4 solution having the following composition was used as an overcoat layer solution instead of the E1 solution, and that a C2 solution having the following composition was used as a thermosensitive recording layer solution instead of the C1 solution.

| [E4 solution] | |
|---|---|
| D solution | 75 parts |
| 10% aqueous solution of diacetone-modified polyvinyl alcohol | 100 parts |
| 10% aqueous solution of N-aminopolyacrylamide (molecular weight: 10,000, hydrazide ratio: 50%) | 15 parts |
| 1% aqueous solution of ammonia | 5 parts |
| water | 105 parts |

Subsequently, the A solution and the B solution were agitated and mixed together with the following proportion so as to prepare the thermosensitive recording layer solution [C2 solution].

| [C2 solution] | |
|---|---|
| dye dispersion solution [A solution] | 50 parts |
| developer dispersion solution [B solution] | 302 parts |
| zirconium phosphate-silver | 0.12 parts |
| 2-(4-thiazolyl)-benzimidazole | 0.12 parts |

Example 5

Thermosensitive recording paper was obtained in the same manner as in Example 1, except that an undercoat layer solution [F1 solution] having the following composition was prepared and then applied between the thermosensitive recording layer and the support such that the amount of the solution attached was 3.0 g/m$^2$ after dried and an undercoat layer was thus provided, and that the E4 solution was used as an overcoat layer solution instead of the E1 solution.

<Preparation of Undercoat Layer Solution>

The following composition was mixed and agitated so as to prepare an undercoat layer solution [F1 solution].

| [F1 solution] | |
|---|---|
| non-expandable plastic fine hollow particle (copolymer resin composed mainly of vinylidene chloride and acrylonitrile, hollowness: 90%, solid content: 32%) | 30 parts |
| styrene-butadiene copolymer latex (PA-9159, produced by NIPPON A&L INC., solid content concentration: 47.5%) | 10 parts |
| zirconium phosphate-silver | 0.03 parts |
| 2-(4-thiazolyl)-benzimidazole | 0.03 parts |
| water | 60 parts |

Example 6

Thermosensitive recording paper was obtained in the same manner as in Example 1, except that a back coat layer solution [G1 solution] having the following composition was prepared and then applied onto the back surface of the support such that the amount of the solution attached was 1.5 g/m$^2$ after dried and a back coat layer was thus provided, and that the E4 solution was used as an overcoat layer solution instead of the E1 solution.

<Preparation of Back Coat Layer Solution>

The following composition was mixed and agitated so as to prepare a back coat layer solution [G1 solution].

| [G1 solution] | |
|---|---|
| 10% aqueous solution of polyvinyl alcohol | 100 parts |
| kaolin (ULTRAWHITE 90, produced by Engelhard Corporation) | 10 parts |
| zirconium phosphate-silver | 0.04 parts |
| 2-(4-thiazolyl)-benzimidazole | 0.04 parts |
| water | 90 parts |

Example 7

Thermosensitive recording paper was obtained in the same manner as in Example 1, except that an undercoat layer solution [F2 solution] having the following composition was prepared and then applied between the thermosensitive recording layer and the support such that the amount of the solution attached was 3.0 g/m$^2$ after dried and an undercoat layer was thus provided, and that a back coat layer solution [G2 solution] having the following composition was prepared and then applied onto the back surface of the support such that the amount of the solution attached was 1.5 g/m$^2$ after dried and a back coat layer was thus provided.

| [F2 solution] | |
|---|---|
| non-expandable plastic fine hollow particle (copolymer resin composed mainly of vinylidene chloride and acrylonitrile hollowness: 90%, solid content: 32%) | 30 parts |
| styrene-butadiene copolymer latex (PA-9159, produced by NIPPON A&L INC., solid content concentration: 47.5%) | 10 parts |
| water | 60 parts |

| [G2 solution] | |
|---|---|
| 10% aqueous solution of polyvinyl alcohol | 100 parts |
| kaolin (ULTRAWHITE 90, produced by Engelhard Corporation) | 10 parts |
| water | 90 parts |

Example 8

Thermosensitive recording paper was obtained in the same manner as in Example 7, except that an E5 solution having the following composition was used as an overcoat layer solution instead of the E1 solution.

| [E5 solution] | |
|---|---|
| D solution | 75 parts |
| 10% aqueous solution of diacetone-modified polyvinyl alcohol | 100 parts |
| 10% aqueous solution of N-aminopolyacrylamide (molecular weight: 10,000, hydrazide ratio: 50%) | 15 parts |
| zirconium phosphate-silver | 0.03 parts |
| 2-(4-thiazolyl)-benzimidazole | 0.03 parts |
| sodium 2-pyridinethiol-1-oxide | 0.04 parts |
| 1% aqueous solution of ammonia | 5 parts |
| water | 105 parts |

Example 9

Thermosensitive recording paper was obtained in the same manner as in Example 8, except that a compound represented by General Formula (I) (a mixture (n=1 to 7) composed mainly of 4,4'-[oxybis(ethyleneoxy-p-phenylenesulfonyl)] diphenol) was used instead of the 4-hydroxy-4'-isopropoxydiphenylsulfone in the B solution contained in the thermosensitive recording layer solution.

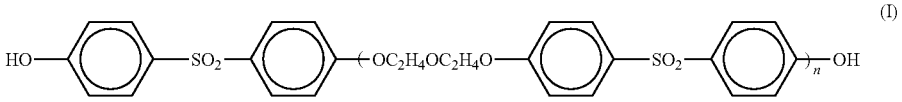

(I)

(In General Formula (I), n denotes a natural number of 1 to 7.)

Example 10

Thermosensitive recording paper was obtained in the same manner as in Example 9, except that zirconium phosphate-copper was used instead of the zirconium phosphate-silver in the overcoat layer solution [E5 solution].

Example 11

Thermosensitive recording paper was obtained in the same manner as in Example 9, except that 2-thiocyanomethylthiobenzimidazole was used instead of the 2-(4-thiazolyl)-benzimidazole in the overcoat layer solution [E5 solution].

Example 12

Thermosensitive recording paper was obtained in the same manner as in Example 9, except that zinc 2-pyridinethiol-1-oxide was used instead of the sodium 2-pyridinethiol-1-oxide in the overcoat layer solution [E5 solution].

Comparative Example 1

Thermosensitive recording paper was obtained in the same manner as in Example 1, except that the 2-(4-thiazolyl)-benzimidazole was removed from the overcoat layer solution [E1 solution].

Comparative Example 2

Thermosensitive recording paper was obtained in the same manner as in Example 1, except that the zirconium phosphate-silver was removed from the overcoat layer solution [E1 solution].

Comparative Example 3

Thermosensitive recording paper was obtained in the same manner as in Example 1, except that the 2-(4-thiazolyl)-benzimidazole and the zirconium phosphate-silver were removed from the overcoat layer solution [E1 solution].

Comparative Example 4

Thermosensitive recording paper was obtained in the same manner as in Example 4, except that the overcoat layer solution was not applied.

Comparative Example 5

Thermosensitive recording paper was obtained in the same manner as in Example 1, except that an E6 solution having the following composition was used as an overcoat layer solution instead of the E1 solution.

| [E6 solution] | |
|---|---|
| D solution | 300 parts |
| 10% aqueous solution of diacetone-modified polyvinyl alcohol | 400 parts |
| 10% aqueous solution of N-aminopolyacrylamide (molecular weight: 10,000, hydrazide ratio: 50%) | 60 parts |
| hinokitiol | 0.02 parts |
| 1% aqueous solution of ammonia | 20 parts |
| water | 420 parts |

Comparative Example 6

Thermosensitive recording paper was obtained in the same manner as in Example 1, except that titanium dioxide was used instead of the 2-(4-thiazolyl)-benzimidazole in the overcoat layer solution [E1 solution].

Comparative Example 7

Thermosensitive recording paper was obtained in the same manner as in Example 1, except that titanium dioxide was used instead of the zirconium phosphate-silver in the overcoat layer solution [E1 solution].

Comparative Example 8

Thermosensitive recording paper was obtained in the same manner as in Example 1, except that an E7 solution having the following composition was used as an overcoat layer solution instead of the E1 solution.

| [E7 solution] | |
|---|---|
| D solution | 300 parts |
| 10% aqueous solution of diacetone-modified polyvinyl alcohol | 400 parts |
| 10% aqueous solution of N-aminopolyacrylamide (molecular weight: 10,000, hydrazide ratio: 50%) | 60 parts |
| hinokitiol | 0.01 parts |
| biguanide hydrochloride polymer (SAN-AI BAC IB, produced by SAN-AI OIL Co., Ltd.) | 0.01 parts |
| 1% aqueous solution of ammonia | 20 parts |
| water | 420 parts |

The thermosensitive recording papers of Examples and Comparative Examples thus produced were tested as described below for their dynamic color-forming properties after stored. The results are together shown in Table 2.

<Color Formation Sensitivity>

Each of the thermosensitive recording papers was printed (at a printing speed of 4 ips) with an applied energy pulse width of 0.1 msec to 1.2 msec, at intervals of 0.1 msec and at a head power of 0.45 W/dot, using a thermal head (KJT-256-8MGF1, manufactured by KYOCERA Corporation) and a thermosensitive printer (TH-PMD, manufactured by Ohkura Electric Co., LTD.). Then the applied energy (pulse width)

required for the printing density to become 1.00 was calculated from a result of measuring the image density using the Macbeth densitometer RD-914.

With the pulse width of Comparative Example 1 serving as a standard, the following equation was calculated: (Pulse width of Comparative Example 1)/(Pulse width of thermosensitive recording paper measured)=Sensitivity ratio. Note that the larger the value of the sensitivity ratio is, the smaller the energy required for the printing density to become 1.00 is and thus the better the color formation sensitivity (thermal responsiveness) is.

<Test for Plasticizer Resistance>

Each sample was printed under a load of 2 kg/cm$^2$ for one second with a thermal block having a temperature at which the sample had a saturation density, using a heat gradient tester manufactured by Toyo Seiki Seisaku-sho, Ltd., so as to produce a pre-test image sample, and the printing density was measured using the Macbeth densitometer RD-914. Subsequently, three sheets of polyvinyl chloride wrapping film (produced by Shin-Etsu Polymer Co., Ltd.) were laid over the sample, and the sample was left to stand for 15 hours at 40° C. under a load of 5 kg, then the image density was measured using the Macbeth densitometer so as to evaluate the plasticizer resistance of the sample. Judgmental criteria are shown in Table 1 below.

<Test for Plasticizer Resistance after Storage>

The thermosensitive recording papers produced were each stored for one week at a temperature of 40° C. and a relative humidity of 90% and then subjected to the above-mentioned test for plasticizer resistance.

<Test for Antibacterial Efficacy>

In accordance with the antibacterial efficacy testing method of JIS (Japanese Industrial Standards) Z 2801, the thermosensitive recording papers obtained in Examples and Comparative Examples were each cut into a 5 cm×5 cm square as a specimen. *Escherichia coli* was prepared in such an adjusted manner that the number thereof was $1.5\times10^6$, and applied dropwise to the specimen. Subsequently, a polyethylene film was closely attached to the specimen, which was followed by storage at 37° C., the number of viable bacteria present 24 hours afterward was measured, and the antibacterial activity value was calculated by means of the following equation. Judgmental criteria are shown in Table 1 below.

$$R=\{\log(Y/X)-\log(Z/X)\}=\log(Y/Z)$$

R: antibacterial activity value

X: average number of viable bacteria on unprocessed specimen immediately after applied Y: average number of viable bacteria on unprocessed specimen 24 hours afterward Z: average number of viable bacteria on antibacterial specimen 24 hours afterward The thermosensitive recording surface and the back surface of each specimen were tested for antibacterial efficacy.

TABLE 1

| Plasticizer resistance | | Antibacterial activity value | |
|---|---|---|---|
| 1.3 or greater | A | 4 or greater | A |
| 1.1 or greater but less than 1.3 | B | 3 or greater but less than 4 | B |
| 0.9 or greater but less than 1.1 | C | 2 or greater but less than 3 | C |
| less than 0.9 | D | less than 2 | D |

TABLE 2

| | Color formation | Plasticizer resistance | | | Antibacterial efficacy | | | |
|---|---|---|---|---|---|---|---|---|
| | sensitivity (ratio) | Before test | After storage | | Thermosensitive recording surface | | Back surface | |
| Ex. 1 | 1.00 | 1.30 | 1.13 | B | 5.2 | A | 3.8 | B |
| Ex. 2 | 1.01 | 1.34 | 1.19 | B | 3.3 | B | 2.4 | C |
| Ex. 3 | 0.98 | 1.28 | 0.99 | C | 6.1 | A | 4.4 | A |
| Ex. 4 | 0.99 | 1.29 | 1.20 | B | 3.2 | B | 2.7 | C |
| Ex. 5 | 1.12 | 1.36 | 1.26 | B | 3.1 | B | 2.5 | C |
| Ex. 6 | 1.00 | 1.31 | 1.22 | B | 2.2 | C | 5.7 | A |
| Ex. 7 | 1.14 | 1.35 | 1.29 | B | 5.3 | A | 4.9 | A |
| Ex. 8 | 1.13 | 1.34 | 1.32 | A | 6.9 | A | 5.1 | A |
| Ex. 9 | 1.14 | 1.35 | 1.31 | A | 6.5 | A | 4.9 | A |
| Ex. 10 | 1.12 | 1.34 | 1.30 | A | 6.1 | A | 4.6 | A |
| Ex. 11 | 1.10 | 1.33 | 1.25 | B | 5.8 | A | 4.2 | A |
| Ex. 12 | 1.13 | 1.36 | 1.28 | B | 6.6 | A | 5.0 | A |
| Comp. Ex. 1 | 1.00 | 1.36 | 1.24 | B | 2.7 | C | 1.1 | D |
| Comp. Ex. 2 | 0.99 | 1.36 | 1.25 | B | 2.6 | C | 1.8 | D |
| Comp. Ex. 3 | 0.98 | 1.36 | 1.31 | A | 1.0 | D | 1.0 | D |
| Comp. Ex. 4 | 1.28 | 1.37 | 0.50 | D | 4.7 | A | 3.4 | B |
| Comp. Ex. 5 | 0.94 | 1.27 | 0.51 | D | 2.4 | C | 2.4 | C |
| Comp. Ex. 6 | 1.00 | 1.30 | 1.25 | B | 5.1 | A | 1.1 | D |
| Comp. Ex. 7 | 1.00 | 1.32 | 1.22 | B | 3.3 | B | 1.7 | D |
| Comp. Ex. 8 | 0.92 | 1.28 | 0.52 | D | 3.2 | B | 2.1 | C |

[Thermosensitive Recording Adhesive Label]

Thermosensitive recording adhesive labels were produced in accordance with the formulations of Examples 13 to 25 and Comparative Examples 9 to 13 below.

Example 13

Preparation of Thermosensitive Recording Layer Solution

The A solution and the B solution were agitated and mixed together with the following proportion so as to prepare a thermosensitive recording layer solution [C3 solution].

| [C3 solution] | |
|---|---|
| dye dispersion solution [A solution] | 50 parts |
| developer dispersion solution [B solution] | 292 parts |

<Preparation of Overcoat Layer Solution>

Subsequently, the following composition was mixed and agitated so as to prepare an overcoat layer solution [E8 solution].

| [E8 solution] | |
|---|---|
| D solution | 75 parts |
| 10% aqueous solution of diacetone-modified polyvinyl alcohol | 100 parts |
| 10% aqueous solution of N-aminopolyacrylamide (molecular weight: 10,000, hydrazide ratio: 50%) | 15 parts |
| 1% aqueous solution of ammonia | 5 parts |
| water | 90 parts |

<Production of Thermosensitive Recording Material>

The thermosensitive recording layer solution [C3 solution] and the overcoat layer solution [E8 solution] were applied onto the surface of commercially available high-quality paper (having a basis weight of 60 g/m$^2$) serving as a support and then dried so as to have masses of 2.85 g/m$^2$ and 3.0 g/m$^2$ respectively after dried. Then the paper with the dried solutions was calendered such that the surface had an Oken-type smoothness of approximately 2,000 seconds, and a thermosensitive recording material was thus produced.

<Preparation of Adhesive Layer Solution>

The following composition was mixed and agitated so as to prepare an adhesive layer solution [H1 solution].

| [H1 solution] | |
|---|---|
| zirconium phosphate-silver | 0.06 parts |
| 2-(4-thiazolyl)-benzimidazole | 0.06 parts |
| pressure-sensitive adhesive acrylic emulsion (BPW6111, solid content: 60%, produced by TOYO INK MFG. CO., LTD.) | 100 parts |

<Production of Thermosensitive Recording Adhesive Label>

Next, the adhesive layer solution was applied onto release paper (LSW, produced by LINTEC Corporation) using a wire bar and dried such that the amount of the solution attached was 20 g/m$^2$ after dried. Then the paper coated with the adhesive was stuck to the above-mentioned thermosensitive recording material and left to stand for 48 hours under a load of 10 kg/(20 cm×30 cm) in a constant-temperature room (23° C., 50%), and a thermosensitive recording adhesive label was thus obtained.

Example 14

A thermosensitive recording adhesive label was obtained in the same manner as in Example 13, except that an undercoat layer solution [F3 solution] having the following composition was prepared and then applied between the thermosensitive recording layer and the support such that the amount of the solution attached was 3.0 g/m$^2$ after dried and an undercoat layer was thus provided.

| [F3 solution] | |
|---|---|
| non-expandable plastic fine hollow particle (copolymer resin composed mainly of vinylidene chloride and acrylonitrile hollowness: 70%, solid content: 32%) | 30 parts |
| styrene-butadiene copolymer latex (PA-9159, produced by NIPPON A&L INC., solid content concentration: 47.5%) | 10 parts |
| water | 60 parts |

Example 15

A thermosensitive recording adhesive label was obtained in the same manner as in Example 14, except that an F4 solution having the following composition was used as an undercoat layer solution instead of the F3 solution.

| [F4 solution] | |
|---|---|
| non-expandable plastic fine hollow particle (copolymer resin composed mainly of vinylidene chloride and acrylonitrile, hollowness: 80%, solid content: 32%) | 30 parts |

-continued

| [F4 solution] | |
|---|---|
| styrene-butadiene copolymer latex (PA-9159, produced by NIPPON A&L INC., solid content concentration: 47.5%) | 10 parts |
| water | 60 parts |

Example 16

A thermosensitive recording adhesive label was obtained in the same manner as in Example 14, except that an F5 solution having the following composition was used as an undercoat layer solution instead of the F3 solution.

| [F5 solution] | |
|---|---|
| non-expandable plastic fine hollow particle (copolymer resin composed mainly of vinylidene chloride and acrylonitrile, hollowness: 90%, solid content: 32%) | 30 parts |
| styrene-butadiene copolymer latex (PA-9159, produced by NIPPON A&L INC., solid content concentration: 47.5%) | 10 parts |
| water | 60 parts |

Example 17

A thermosensitive recording adhesive label was obtained in the same manner as in Example 16, except that an H2 solution having the following composition was used as an adhesive layer solution instead of the H1 solution.

| [H2 solution] | |
|---|---|
| zirconium phosphate-silver | 0.006 parts |
| 2-(4-thiazolyl)-benzimidazole | 0.006 parts |
| pressure-sensitive adhesive acrylic emulsion (BPW6111, solid content: 60%, produced by TOYO INK MFG. CO., LTD.) | 100 parts |

Example 18

A thermosensitive recording adhesive label was obtained in the same manner as in Example 16, except that a H3 solution having the following composition was used as an adhesive layer solution instead of the H1 solution.

| [H3 solution] | |
|---|---|
| zirconium phosphate-silver | 1.1 parts |
| 2-(4-thiazolyl)-benzimidazole | 1.1 parts |
| pressure-sensitive adhesive acrylic emulsion (BPW6111, solid content: 60%, produced by TOYO INK MFG. CO., LTD.) | 100 parts |

Example 19

A thermosensitive recording adhesive label was obtained in the same manner as in Example 16, except that a compound represented by General Formula (I) (a mixture (n=1 to 7) composed mainly of 4,4'-[oxybis(ethyleneoxy-p-phenylenesulfonyl)]diphenol) was used instead of the 4-hydroxy-4'-isopropoxydiphenylsulfone in the B solution contained in the thermosensitive recording layer solution.

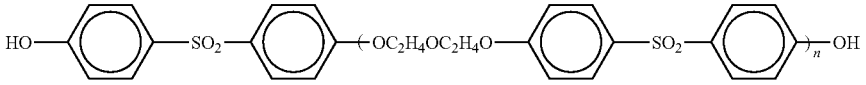

(I)

(In General Formula (I), n denotes a natural number of 1 to 7.)

Example 20

A thermosensitive recording adhesive label was obtained in the same manner as in Example 19, except that zirconium phosphate-copper was used instead of the zirconium phosphate-silver in the adhesive layer solution [H1 solution].

Example 21

A thermosensitive recording adhesive label was obtained in the same manner as in Example 19, except that 2-thiocyanomethylthiobenzimidazole was used instead of the 2-(4-thiazolyl)-benzimidazole in the adhesive layer solution [H1 solution].

Example 22

A thermosensitive recording adhesive label was obtained in the same manner as in Example 16, except that an F6 solution having the following composition was used as an undercoat layer solution instead of the F5 solution, and that an H4 solution having the following composition was used as an adhesive layer solution instead of the H1 solution.

| [F6 solution] | |
|---|---|
| non-expandable plastic fine hollow particle (copolymer resin composed mainly of vinylidene chloride and acrylonitrile, hollowness: 90%, solid content: 32%) | 30 parts |
| styrene-butadiene copolymer latex (PA-9159, produced by NIPPON A&L INC., solid content concentration: 47.5%) | 10 parts |
| zirconium phosphate-silver | 0.6 parts |
| 2-(4-thiazolyl)-benzimidazole | 0.6 parts |
| water | 60 parts |

| [H4 solution] | |
|---|---|
| pressure-sensitive adhesive acrylic emulsion (BPW6111, solid content: 60%, produced by TOYO INK MFG. CO., LTD.) | 100 parts |

Example 23

A thermosensitive recording adhesive label was obtained in the same manner as in Example 16, except that an E9 solution having the following composition was used as an overcoat layer solution instead of the E8 solution, and that the H4 solution was used as an adhesive layer solution instead of the H1 solution.

| [E9 solution] | |
|---|---|
| D solution | 75 parts |
| 10% aqueous solution of diacetone-modified polyvinyl alcohol | 100 parts |
| 10% aqueous solution of N-aminopolyacrylamide (molecular weight: 10,000, hydrazide ratio: 50%) | 15 parts |

-continued

| [E9 solution] | |
|---|---|
| 1% aqueous solution of ammonia | 5 parts |
| zirconium phosphate-silver | 1.2 parts |
| 2-(4-thiazolyl)-benzimidazole | 1.2 parts |
| water | 90 parts |

Example 24

A thermosensitive recording adhesive label was obtained in the same manner as in Example 16, except that a back coat layer solution [G3 solution] having the following composition was applied onto the back surface of the support and dried so as to form a back coat layer (1.5 g/m$^2$) on the back surface, and that the H4 solution was used as an adhesive layer solution instead of the H1 solution.

<Preparation of Back Coat Layer Solution>

The G3 solution was prepared by mixing and agitating the following composition.

| [G3 solution] | |
|---|---|
| 10% aqueous solution of polyvinyl alcohol | 100 parts |
| kaolin (ULTRAWHITE 90, produced by Engelhard Corporation) | 10 parts |
| zirconium phosphate-silver | 2.5 parts |
| 2-(4-thiazolyl)-benzimidazole | 2.5 parts |
| water | 90 parts |

Example 25

A thermosensitive recording adhesive label was obtained in the same manner as in Example 13, except that an H5 solution having the following composition was used instead of the H1 solution.

| [H5 solution] | |
|---|---|
| zirconium phosphate-silver | 0.04 parts |
| 2-(4-thiazolyl)-benzimidazole | 0.04 parts |
| sodium 2-pyridinethiol-1-oxide | 0.04 parts |
| pressure-sensitive adhesive acrylic emulsion (BPW6111, solid content: 60%, produced by TOYO INK MFG. CO., LTD.) | 100 parts |

Comparative Example 9

A thermosensitive recording adhesive label was obtained in the same manner as in Example 13, except that the 2-(4-thiazolyl)-benzimidazole was removed from the adhesive layer solution [H1 solution].

Comparative Example 10

A thermosensitive recording adhesive label was obtained in the same manner as in Example 13, except that the zirconium phosphate-silver was removed from the adhesive layer solution [H1 solution].

Comparative Example 11

A thermosensitive recording adhesive label was obtained in the same manner as in Example 13, except that the 2-(4-thiazolyl)-benzimidazole and the zirconium phosphate-silver were removed from the adhesive layer solution [H1 solution].

Comparative Example 12

A thermosensitive recording adhesive label was obtained in the same manner as in Example 13, except that the overcoat layer solution was not applied.

Comparative Example 13

A thermosensitive recording adhesive label was obtained in the same manner as in Example 13, except that an H5 solution having the following composition was used as an adhesive layer solution instead of the H1 solution.

| [H5 solution] | |
|---|---|
| hinokitiol | 0.12 parts |
| pressure-sensitive adhesive acrylic emulsion (BPW6111, solid content: 60%, produced by TOYO INK MFG. CO., LTD.) | 100 parts |

The thermosensitive recording adhesive labels of Examples and Comparative Examples thus produced were tested for their dynamic color-forming properties after stored, in the same manner as in the above-mentioned test for Examples 1 to 12, except that the thermosensitive recording adhesive labels were used instead of the thermosensitive recording papers. In addition, the thermosensitive recording adhesive labels were tested for their adhesive force in the following manner. The results are together shown in Table 3.

<Adhesive Force>

Each of the thermosensitive recording adhesive labels was cut into a 25 mm×100 mm rectangle and affixed to an object (SUS (steel use stainless) plate) in a lengthwise direction using a rubber roller with a pressurizing force of 2 kg; 30 minutes after, each label was separated from the object at a separation angle of 180° and a separation rate of 300 mm/min. The adhesive force of each label at that time was measured using a force gauge, data were read at intervals of 0.1 seconds, and the values obtained by averaging the data are shown in Table 3. N/25 mm was used as the unit for the measurement of the adhesive force. This test for adhesive force was carried out at normal temperature (at a temperature of 23° C. and a relative humidity of 50%).

TABLE 3

| | Color formation | Plasticizer resistance | | | Antibacterial efficacy | | | | | | Adhesive |
|---|---|---|---|---|---|---|---|---|---|---|---|
| | sensitivity (ratio) | Before test | After storage | | Adhesive surface | | Wrap surface | | Thermosensitive recording surface | | force N/25 mm |
| Ex. 13 | 1.00 | 1.31 | 1.16 | B | 6.5 | A | 3.9 | B | 3.1 | B | 18.6 |
| Ex. 14 | 1.01 | 1.34 | 1.18 | B | 6.1 | A | 3.4 | B | 3.3 | B | 19.7 |
| Ex. 15 | 1.05 | 1.35 | 1.21 | B | 6.3 | A | 3.9 | B | 3.6 | B | 20.2 |
| Ex. 16 | 1.08 | 1.36 | 1.20 | B | 5.9 | A | 6.2 | A | 3.6 | B | 19.8 |
| Ex. 17 | 1.12 | 1.36 | 1.24 | B | 3.3 | B | 2.7 | C | 2.6 | C | 20.1 |
| Ex. 18 | 1.13 | 1.33 | 0.98 | C | 6.8 | A | 6.2 | A | 5.5 | A | 20.5 |
| Ex. 19 | 1.14 | 1.35 | 1.30 | A | 6.3 | A | 3.4 | B | 3.2 | B | 20.0 |
| Ex. 20 | 1.13 | 1.36 | 1.31 | A | 5.4 | B | 3.5 | B | 3.1 | B | 20.1 |
| Ex. 21 | 1.13 | 1.35 | 1.31 | A | 5.6 | B | 3.0 | B | 3.7 | B | 19.8 |
| Ex. 22 | 1.11 | 1.34 | 1.27 | B | 2.5 | C | 2.0 | C | 3.5 | B | 19.7 |
| Ex. 23 | 1.10 | 1.33 | 1.06 | C | 3.3 | B | 2.1 | C | 6.7 | A | 20.2 |
| Ex. 24 | 1.08 | 1.35 | 1.25 | B | 3.9 | B | 2.0 | C | 3.3 | B | 20.9 |
| Ex. 25 | 1.01 | 1.32 | 1.17 | B | 6.8 | A | 5.1 | A | 4.4 | A | 18.8 |
| Comp. Ex. 9 | 1.00 | 1.36 | 1.24 | B | 6.2 | A | 1.1 | D | 1.3 | D | 18.7 |
| Comp. Ex. 10 | 1.01 | 1.36 | 1.25 | B | 2.2 | C | 2.3 | C | 1.8 | D | 18.5 |
| Comp. Ex. 11 | 0.99 | 1.36 | 1.31 | A | 1.0 | D | 1.0 | D | 1.0 | D | 18.7 |
| Comp. Ex. 12 | 1.28 | 1.37 | 0.53 | D | 5.9 | A | 5.1 | A | 3.6 | B | 17.5 |
| Comp. Ex. 13 | 0.99 | 1.27 | 0.72 | D | — | — | — | — | 2.4 | C | 18.4 |

The results of Tables 2 and 3 revealed that the thermosensitive recording papers and the thermosensitive recording adhesive labels of Examples 1 to 25 were superior to those of Comparative Examples 1 to 13 in plasticizer resistance after storage and in antibacterial efficacy. As to this antibacterial efficacy, Comparative Examples 1 to 13 revealed that when either a zirconium phosphate antibacterial agent or an imidazole antibacterial agent was not used, favorable antibacterial efficacy could not be obtained, and that when other antibacterial agent(s) was/were used or when either a zirconium phosphate antibacterial agent or an imidazole antibacterial agent was combined with other antibacterial agent(s), favorable antibacterial efficacy could not be obtained either. Meanwhile, Examples 1 to 25, in which a zirconium phosphate antibacterial agent and an imidazole antibacterial agent were combined together, had superior antibacterial properties.

It is inferred that this is because the other antibacterial agents could not withstand the heat applied to the thermosensitive recording medium of the present invention. These results show that the thermosensitive recording medium of the present invention is advantageous in that it can exhibit superior antibacterial properties even when heat is applied thereto and/or it is used at high humidity.

What is claimed is:

1. A thermosensitive recording medium comprising:

a support;

a thermosensitive recording layer composed mainly of a leuco dye and a developer, formed on a surface of the support; and at least two antibacterial agents which include a zirconium phosphate antibacterial agent and an imidazole antibacterial agent and which are internally contained in the thermosensitive recording medium.

2. The thermosensitive recording medium according to claim 1, wherein the developer is a compound represented by General Formula (1) below:

(I)

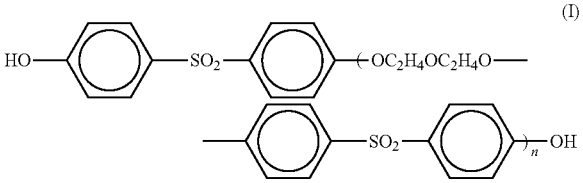

where n denotes a natural number of 1 to 7.

3. The thermosensitive recording medium according to claim 1, further comprising an overcoat layer on the thermosensitive recording layer.

4. The thermosensitive recording medium according to claim 3, wherein the overcoat layer comprises the at least two antibacterial agents which include the zirconium phosphate antibacterial agent and the imidazole antibacterial agent.

5. The thermosensitive recording medium according to claim 3, wherein the overcoat layer comprises a pyridine antibacterial agent.

6. The thermosensitive recording medium according to claim 1, further comprising an undercoat layer between the support and the thermosensitive recording layer.

7. The thermosensitive recording medium according to claim 6, wherein the undercoat layer contains hollow particles having a hollowness of 80% or more.

8. The thermosensitive recording medium according to claim 6, wherein the undercoat layer comprises the at least two antibacterial agents which include the zirconium phosphate antibacterial agent and the imidazole antibacterial agent.

9. The thermosensitive recording medium according to claim 1, further comprising a back coat layer on a side of the support opposite to the thermosensitive recording layer.

10. The thermosensitive recording medium according to claim 9, wherein the back coat layer comprises the at least two antibacterial agents which include the zirconium phosphate antibacterial agent and the imidazole antibacterial agent.

11. The thermosensitive recording medium according to claim 1, further comprising a pyridine antibacterial agent internally contained therein.

12. The thermosensitive recording medium according to claim 11, wherein the pyridine antibacterial agent is a pyridinethiol compound.

13. The thermosensitive recording medium according to claim 1, being used as thermosensitive recording paper.

14. The thermosensitive recording medium according to claim 1, further comprising an acrylic adhesive layer and release paper sequentially formed on a side of the support opposite to the thermosensitive recording layer.

15. The thermosensitive recording medium according to claim 14, wherein the acrylic adhesive layer comprises the at least two antibacterial agents which include the zirconium phosphate antibacterial agent and the imidazole antibacterial agent.

16. The thermosensitive recording medium according to claim 14, wherein the acrylic adhesive layer comprises a pyridine antibacterial agent.

17. The thermosensitive recording medium according to claim 14, being used as a thermosensitive recording adhesive label.

18. A thermosensitive recording medium comprising:

a support;

a thermosensitive recording layer composed mainly of a leuco dye and a developer, formed on a surface of the support; and at least two antibacterial agents which include a zirconium phosphate antibacterial agent and an imidazole antibacterial agent and which are internally contained in the thermosensitive recording medium, wherein the zirconium phosphate antibacterial agent is zirconium phosphate-silver or zirconium phosphate-copper.

* * * * *